US005433684A

United States Patent [19]

Carrillo

[11] Patent Number: 5,433,684

[45] Date of Patent: Jul. 18, 1995

[54] CALF WORKOUT DEVICES

[76] Inventor: Adrian P. Carrillo, 1609 McDonald Rd., NW., Albuquerque, N. Mex. 87107

[21] Appl. No.: 236,183

[22] Filed: May 2, 1994

[51] Int. Cl.[6] ..... A63B 23/08; A63B 21/02

[52] U.S. Cl. ..... 482/80; 482/123; 482/129; 482/146

[58] Field of Search ..... 482/79, 80, 121, 122, 482/123, 129, 146

[56] References Cited

U.S. PATENT DOCUMENTS

| | | | |
|---|---|---|---|
| 3,421,760 | 1/1969 | Freeman, Jr. | 482/80 |
| 3,741,540 | 6/1973 | Shimizu | 482/80 |
| 4,501,421 | 2/1985 | Kane et al. | 482/80 |

FOREIGN PATENT DOCUMENTS

| | | | |
|---|---|---|---|
| 0453095 | 10/1991 | European Pat. Off. | 482/79 |

*Primary Examiner*—Richard J. Apley
*Assistant Examiner*—Lynne A. Reichard

[57] ABSTRACT

A calf workout device comprises a base formed in a generally planar rectangular configuration with a toe side edge, a heel side edge, and parallel long side edges. The base includes two planar side faces which extend vertically upward from the long side edges. Each side face includes a coupling device at its approximate center point. A foot plate is shaped in a generally rectangular configuration with a toe edge, a heel edge, and parallel long side edges. The toe edge is linear and the heel edge is formed in a semi-circular configuration. The heel edge includes an upwardly extending cylindrical wall. The approximate center point of the long edges of the plate include an aperture which extends from side to side. A cylindrical axle is positioned through the foot plate with its ends coupled to the side faces. The foot plate includes a resilient device for urging the plate in one direction.

5 Claims, 3 Drawing Sheets

CALF WORKOUT DEVICES

BACKGROUND OF THE INVENTION

1. Field of the Invention

The present invention relates to calf workout devices and more particularly pertains to exercising one's calf muscles by flexion of the foot on a vertically pivoting foot plate.

2. Description of the Prior Art

The use of leg exercise machines is known in the prior art. More specifically, leg exercise machines heretofore devised and utilized for the purpose of exercising a plurality of different leg muscles are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,194,060 to Marchetti a fold-away, multi-calf exercise device.

U.S. Pat. No. 4,822,038 to Maag discloses a calf isolating exercise machine.

U.S. Pat. No. 5,087,036 to Cooper discloses an exercise device and method for foot muscle stretching.

U.S. Pat. No. 5,135,457 to Caruso discloses a calf exercise machine.

Lastly, U.S. Pat. No. 4,236,712 to Lambert, Jr. discloses a standing calf exercise machine.

In this respect, the calf workout devices according to the present invention substantially departs from the conventional concepts and designs of the prior art, and in doing so provides an apparatus primarily developed for the purpose of exercising one's calf muscles by flexion of the foot on a vertically pivoting foot plate.

Therefore, it can be appreciated that there exists a continuing need for new and improved calf workout devices which can be used for exercising one's calf muscles by flexion of the foot on a vertically pivoting foot plate. In this regard, the present invention substantially fulfills this need.

SUMMARY OF THE INVENTION

In view of the foregoing disadvantages inherent in the known types of leg exercise machines now present in the prior art, the present invention provides an improved calf workout devices. As such, the general purpose of the present invention, which will be described subsequently in greater detail, is to provide a new and improved calf workout devices and method which has all the advantages of the prior art and none of the disadvantages.

To attain this, the present invention essentially comprises a new and improved calf workout device including a base formed in a generally planar rectangular configuration. The base has a toe side edge, a heel side edge, and parallel long side edges. The base is positioned on the floor in the operative orientation. Two side faces extend upwardly from the long side edges. The side faces are formed in a generally planar triangular configuration with two side edges of equal length, and one long lower edge. The plane of the side faces is positioned in a vertical orientation with the apex of the triangle pointing upward. Each side face includes a circular hole slightly below its apex and a generally rectangular aperture slightly above the center point of the lower edge. The horizontal lower portion of the base includes a rubber foot pad located beneath each of its corners. A bracket is formed in the shape of an inverted Y and consists of an upper segment and two lower segments. The lower segments are formed as generally planar rectangular bars which are shaped in an inverted L-shape configuration with rounded bends. Each bar has an inner surface and an outer surface and includes an inwardly curved rectangular notch at its lowermost extent. A circular hole is located a short distance above the notch. The notch is adapted to be coupled inside the rectangular apertures in the side faces. The upper segment is formed contiguously with the uppermost extents of the lower segments. The upper segment is formed in a generally planar rectangular configuration with a plurality of downwardly angled grooves and is positioned above the approximate center point of the base. The space between the lower segments of the bracket is adapted to allow for the passage of a user's foot. A foot plate is shaped in a generally rectangular configuration with a toe edge, a heel edge, and parallel long side edges. The toe edge is linear and includes a downwardly angled hook affixed to its center point. The heel edge is formed in a semi-circular configuration to follow the contour of a user's heel. The heel edge also includes an upwardly extending semi-circular shaped wall which is also adapted to follow the contour of a user's heel. The height of the edges of the wall is lower than the height of its center point, with a gradually decreasing height therebetween. The center point of the long edge of the plate includes a circular aperture which extends from side to side. The plate includes a rubber cushion affixed to the lower surface of the center point of its heel edge. The foot plate is adapted to be positioned on the base in the operative orientation. An axle is formed in a long generally cylindrical configuration with a planar head at one end and a radial hole at the other end. The hole extends through the cylindrical side walls in proximity to the end. The axle includes two washers cooperatively coupled thereto. The axle is positioned through the aligned apertures in the side faces and foot plate with the washers positioned on the outer surfaces of the side faces. A retainer pin shaped in a generally U-shaped configuration is releasably coupled through the circular hole in the axle to secure it in position. The axle is adapted to allow pivoting of the foot plate thereabout. A tension band is comprised of flexible materials and shaped in a generally rectangular configuration with circular members at both ends. The circular members include central apertures. A ring is formed at each end, with each positioned through the apertures in the circular members. One ring is positioned in one of the grooves in the upper segment of the bracket. The other ring is positioned on the hook on the toe edge of the foot plate in the operative orientation. The tension band is adapted to stretch when the user's foot flexes forward in the foot plate, and retract back to its original length when the user's foot is flexed backward.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved calf workout devices which have all the advantages of the prior art leg exercise machines and none of the disadvantages.

It is another object of the present invention to provide new and improved calf workout devices which may be easily and efficiently manufactured and marketed.

It is further object of the present invention to provide new and improved calf workout devices which are of durable and reliable constructions.

An even further object of the present invention is to provide new and improved calf workout devices which are susceptible of a low cost of manufacture with regard to both materials and labor, and which accordingly are then susceptible of low prices of sale to the consuming public, thereby making such calf workout devices economically available to the buying public.

Still yet another object of the present invention is to provide new and improved calf workout devices which provide in the apparatuses and methods of the prior art some of the advantages thereof, while simultaneously overcoming some of the disadvantages normally associated therewith.

Still another object of the present invention is to exercise one's calf muscles by flexion of the foot on a vertically pivoting foot plate.

Lastly, it is an object of the present invention to provide new and improved calf workout devices comprising a base formed in a generally planar rectangular configuration with a toe side edge, a heel side edge, and parallel long side edges. The base includes two planar side faces which extend vertically upward from the long side edges. Each side face includes a coupling device at its approximate center point. A foot plate is shaped in a generally rectangular configuration with a toe edge, a heel edge, and parallel long side edges. The toe edge is linear and the heel edge is formed in a semicircular configuration. The heel edge includes an upwardly extending cylindrical wall. The approximate center point of the long edges of the plate include an aperture which extends from side to side. A cylindrical axle is positioned through the foot plate with its ends coupled to the side faces. The foot plate includes a resilient device for urging the plate in one direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
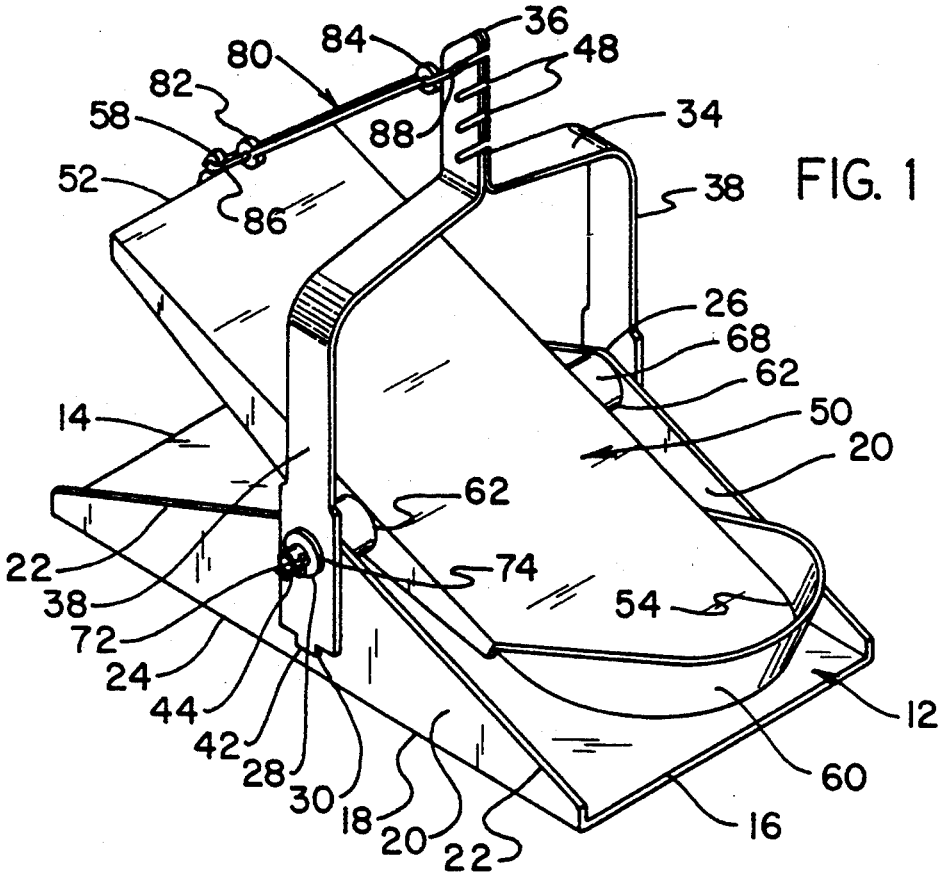
FIG. 1 is a perspective view of the preferred embodiment of the calf workout device constructed in accordance with the principles of the present invention.
Figure 2:
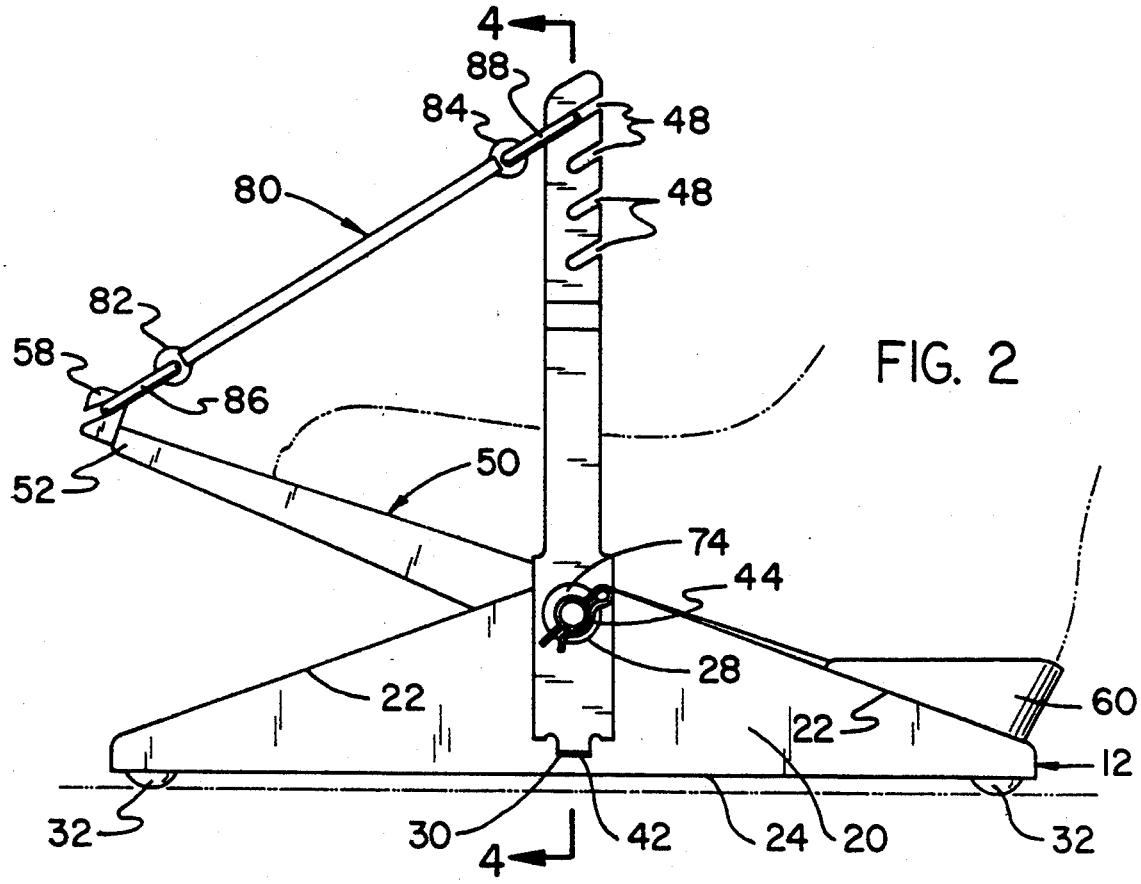
FIG. 2 is a side perspective view of the apparatus shown in FIG. 1.
Figure 3:
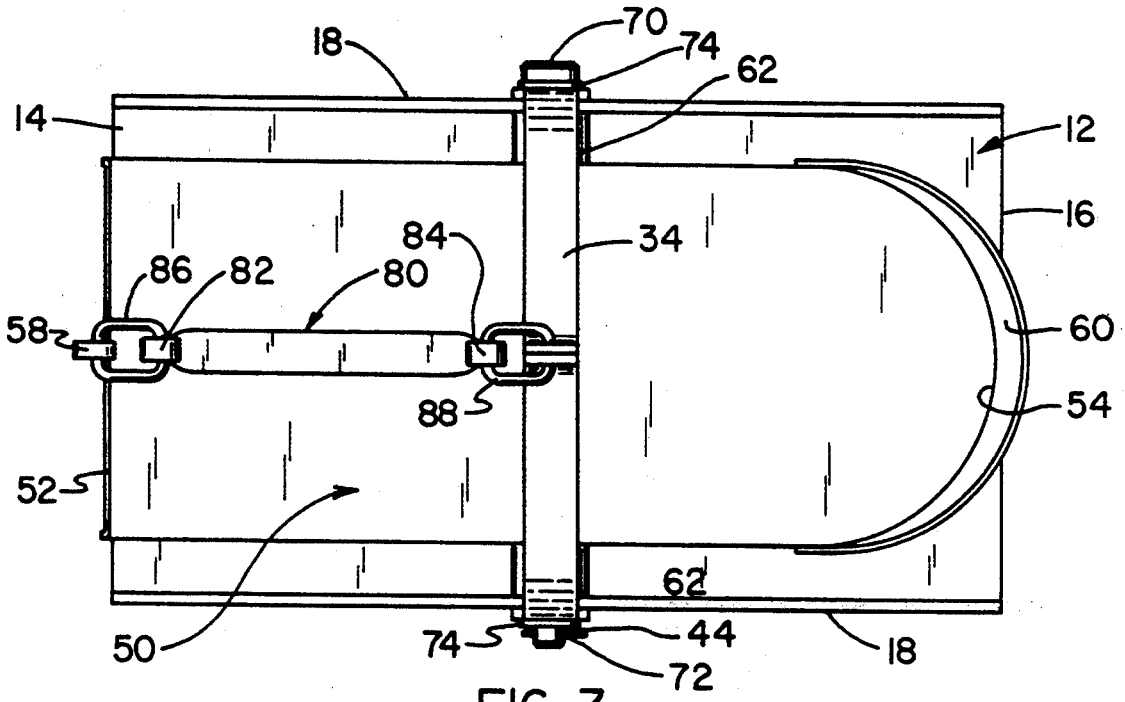
FIG. 3 is a top plan view of the calf workout device illustrating the tension band.
Figure 4:
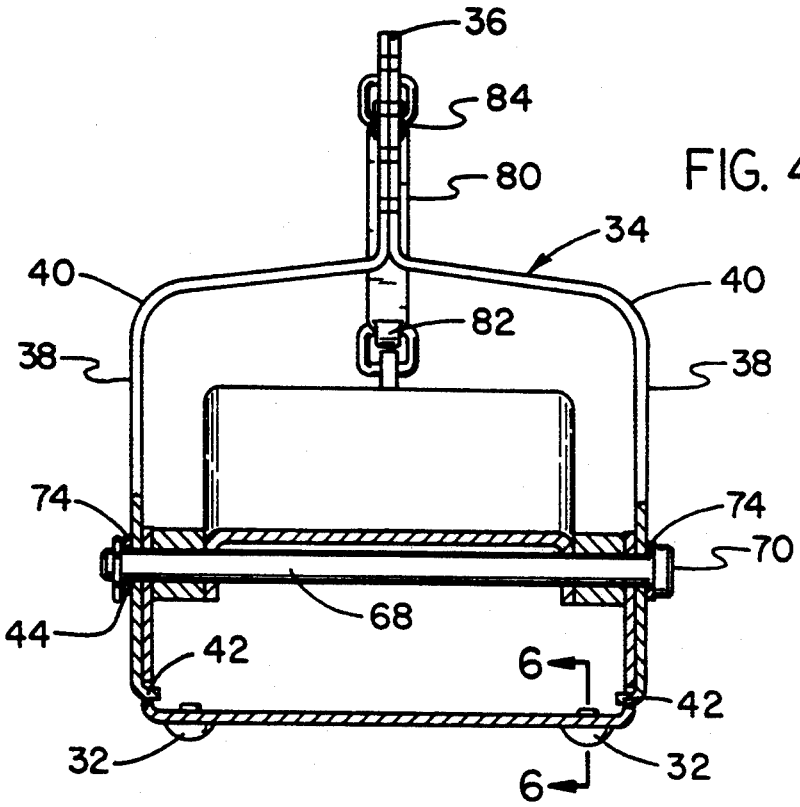
FIG. 4 is a cross sectional view taken along line 4—4 of FIG. 2 illustrating the axle and associated components.
Figure 5:
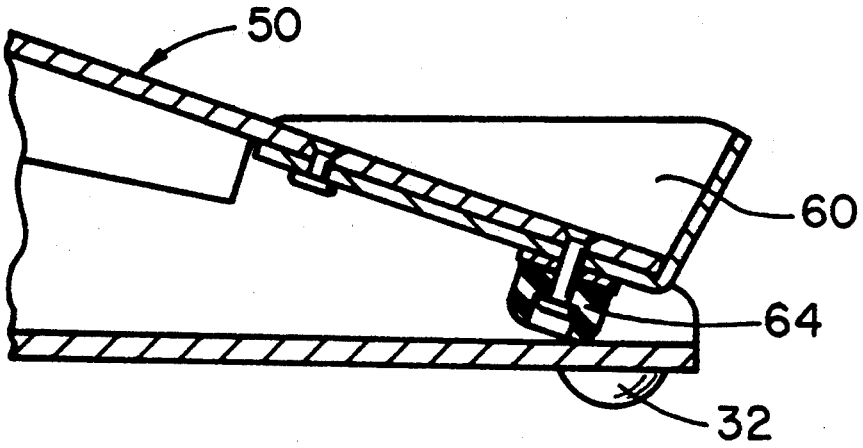
FIG. 5 is a broken away side perspective view of the foot plate and its associated rubber cushion.
Figure 6:
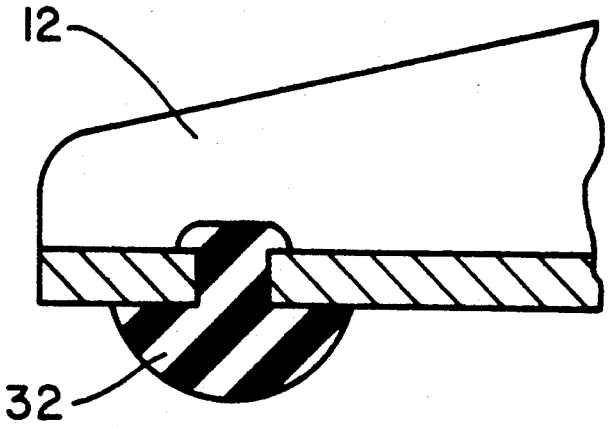
FIG. 6 is a cross sectional view taken along line 6—6 of FIG. 4 illustrating the foot pad of the apparatus.

With reference now to the drawings, and in particular to FIG. 1 thereof, the preferred embodiment of the new and improved calf workout devices embodying the principles and concepts of the present invention and generally designated by the reference numeral 10 will be described.

Specifically, it will be noted in FIGS. 1 through 6, that there is provided a new and improved calf workout device. The calf workout device 10, in its broadest context, comprises a base 12, a bracket 34, a foot plate 50, an axle 68 and a tension band 80.

More specifically, the base 12 has a toe side edge 14, a heel side edge 16, and parallel long side edges 18. The base 12 is positioned on the floor in the operative orientation. Two side faces 20 extend upwardly from the long side edges 18. The side faces 20 are formed in a generally planar triangular configuration with two side edges of equal length 22, and one long lower edge 24. The plane of the side faces 20 is positioned in a vertical orientation with the apex 26 of the triangle pointing upward. Each side face 20 includes a circular hole 28 slightly below its apex 26 and a generally rectangular aperture 30 slightly above the center point of the lower edge 24. The horizontal lower portion of the base 12 includes a rubber foot pad 32 located beneath each of its corners. The secure footing provided by the foot pads permit the user to use the apparatus on a carpet, tile floor or outdoor surface. Note FIGS. 2, 4 and 6.

The second component of the apparatus is a bracket 34 formed in the shape of an inverted Y and consists of an upper segment 36 and two lower segments 38. The lower segments 38 are formed as generally planar rectangular bars which are shaped in an inverted L-shape configuration with rounded bends 40. Each lower segment 38 has an inner surface and an outer surface and includes an inwardly curved rectangular notch 42 at its lowermost extent. A circular hole 44 is located a short distance above the notch 42. The notch 42 is adapted to be releasably coupled inside the rectangular apertures 30 in the side faces. The bracket is easily detachable from the side faces when disassembly is required. Note FIGS. 1 and 2.

The upper segment 36 is formed contiguously with the uppermost extents of the lower segments. The upper segment 36 is formed in a generally planar rectangular configuration with a plurality of downwardly angled grooves 48 and is positioned above the approximate center point of the base 12. The space between the lower segments 38 of the bracket is adapted to allow for the passage of a user's foot. The large height and width of the space prevents the user from contacting the upper segment with his shin. Note FIG. 1.

The third component of the apparatus is a foot plate 50 shaped in a generally rectangular configuration with a toe edge 52, a heel edge 54, and parallel long side edges 56. The toe edge 52 is linear and includes a downwardly angled hook 58 affixed to its center point. The heel edge 54 is formed in a semi-circular configuration to follow the contour of a user's heel. The heel edge 54 also includes an upwardly extending semi-circular shaped wall 60 which is also adapted to follow the contour of a user's heel. The user positions his heel firmly within the contoured wall when using the apparatus. Note FIG. 1. The height of the edges of the wall 60 is lower than the height of its center point, with a gradually decreasing height therebetween. The center point of the long edge of the plate includes a circular aperture 62 which extends from side to side. The plate 50 includes a rubber cushion 64 affixed to the lower surface of the center point of its heel edge 54. The cushion makes the apparatus more comfortable to the user by providing a soft landing surface when flexing backward toward the heel. The foot plate 50 is adapted to be positioned on the base 12 in the operative orientation. Note FIGS. 1 and 5.

The fourth component of the apparatus is an axle 68 formed in a long generally cylindrical configuration with a planar head 70 at one end and a radial hole 72 at the other end. The hole 72 extends through the cylindrical side walls in proximity to the end. The axle 68 includes two washers 74 cooperatively coupled thereto. The axle 68 is positioned through the aligned apertures in the side faces and foot plate with the washers 74 positioned on the outer surfaces of the side faces 20. Note FIGS. 3 and 4. A retainer pin 76 shaped in a generally U-shaped configuration is releasably coupled through the circular hole 72 in the axle to secure it in position. Note FIG. 2. The axle 68 is adapted to allow pivoting of the foot plate thereabout. When exercising, the user forces the toe edge to pivot downward and upward in alternate repetitions. Note FIG. 2.

The fifth component of the apparatus is a tension band 80 comprised of flexible materials and shaped in a generally rectangular configuration with circular members 82, 84 at both ends. The circular members 82, 84 include central apertures. A ring is formed at each end 86, 88, with each positioned through the apertures in the circular members 82, 84. One ring 88 is positioned in one of the grooves 48 in the upper segment 36 of the bracket. Placement of the ring in a particular groove results in a unique level of resistance. The other ring 86 is positioned on the hook 58 on the toe edge 52 of the foot plate in the operative orientation. The tension band is adapted to stretch when the user's foot flexes forward in the foot plate 50, and retract back to its original length when the user's foot is flexed backward. The tension provided by the band enhances the muscle building utility of the apparatus. Note FIGS. 1 and 2.

The calf workout device is an apparatus designed for home use. It allows an individual to isolate and exercise his calf muscles during a workout. The axle of the apparatus is detachable from the bracket and foot plate to permit easy disassembly and storage in a suitcase. This allows a user to continue his daily exercise routine even when traveling on business and vacation trips.

The calf workout device is comprised of sturdy materials to permit rigorous usage. The base is positioned horizontally on the floor with the side faces positioned vertically. The bracket forms an arch over the top of the apparatus, with a space underneath sufficiently large for a user's to fit his foot through. The foot plate is coupled to the bracket and side plates by an axle. A tension band extends from the front portion of the foot plate to the top of the bracket.

Operation of the device is quite simple. The user places one of his feet into the foot plate of the apparatus with his heel against the rounded rear portion of the plate. The user then steadily flexes his foot forward with the tension band providing resistance. The plate pivots about the axle causing the users heel to lift off the ground with his toes pointing downward. The user then flexes his heel back to the original position to complete the repetition. These movements exercise primarily the calf muscles of the user. The calf workout device provides a user with an excellent means of keeping his calf muscles in excellent physical condition.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved calf workout devices comprising, in combination:

a base, the base being formed in a generally planar rectangular configuration with a toe side edge, a heel side edge, and parallel long side edges, the base being positioned on the floor in the operative orientation, two side faces extend upwardly from the long side edges, the side faces being formed in a generally planar triangular configuration with two side edges of equal length, and one long lower edge, the plane of the side faces being positioned in a vertical orientation with the apex of the triangle pointing upward, each side face including a circular hole slightly below its apex and a generally rectangular aperture slightly above the center point of the lower edge, the horizontal lower portion of the base including a rubber foot pad located beneath each of its corners;

a bracket, the bracket formed in the shape of an inverted Y and consisting of an upper segment and two lower segments, the lower segments being formed as generally planar rectangular bars shaped in an inverted L-shape configuration with rounded bends, each bar having an inner surface and an outer surface and including an inwardly curved rectangular notch at its lowermost extent with a circular hole located a short distance thereabove, the notch adapted to be coupled inside the rectangular apertures in the side faces, the upper segment being formed contiguously with the uppermost extents of the lower segments and positioned above the approximate center point of the peek of the base, the upper segment formed in a generally planar rectangular configuration with a plurality of downwardly angled grooves, the space between the lower segments adapted to permit the passage of a user's foot;

a foot plate, the plate shaped in a generally rectangular configuration with a toe edge, a heel edge, and parallel long side edges, the toe edge being linear and including a downwardly angled hook affixed to its center point, the heel edge being formed in a semi circular configuration to follow the contour of a user's heel, the heel edge also including an upwardly extending semi-circular shaped wall also adapted to follow the contour of a user's heel, the height of the edges of the wall being lower than its center point with a gradually decreasing height therebetween, the center point of the long edge of the plate including a circular aperture extending from side to side, the plate including a rubber cushion affixed to the lower surface of the center point of its heel edge, the foot plate adapted to be positioned on the base in the operative orientation;

an axle, the axle formed in a long generally cylindrical configuration with a planar head at one end and a radial hole at the other end extending through its cylindrical side walls in proximity to the end, the axle including two washers cooperatively coupled thereto, the axle being positioned through the aligned apertures in the side faces and foot plate with the washers positioned on the outer surfaces of the side faces, a retainer pin shaped in a generally U-shaped configuration being releasably coupled through the circular hole in the axle to secure it in position, the axle adapted to allow pivoting of the foot plate thereabout; and a tension band, the band being comprised of flexible materials and shaped in a generally rectangular configuration with circular members at both ends, the circular members including central apertures, a ring formed at each end, each being positioned through the apertures in the circular members, with one ring being positioned in one of the grooves in the upper segment of the bracket, and the other ring being positioned on the hook on the toe edge of the foot plate in the operative orientation, the tension band adapted to stretch when the user's foot flexes forward in the foot plate, and retract back to its original length when the user's foot is flexed backward.

2. A calf workout device comprising:

a base formed in a generally planar rectangular configuration with a toe side edge, a heel side edge, and parallel long side edges, the base including two planar side faces extending vertically upward from the long side edges, each side face including a coupling device at its approximate center point;

a foot plate shaped in a generally rectangular configuration with a toe edge, a heel edge, and parallel long side edges, the toe edge being linear, the heel edge being formed in a semi circular configuration and including an upwardly extending cylindrical wall, the approximate center point of the long edges of the plate including an aperture extending from side to side, a cylindrical axle being positioned through the foot plate with its ends coupled to the side faces, the foot plate including a resilient device for urging the plate in one direction; and a bracket formed as an inverted Y shaped arch with lower arm segments and an upper segment, the bracket being positioned over the approximate center point of the side plates, the lower arms being coupled to the side plates at their coupling devices, the upper segment including a plurality of grooves angled downwardly toward the toe edge.

3. The apparatus as set forth in claim 2 and further including a tension band comprised of flexible materials and shaped in a generally rectangular configuration with rings coupled to each end, with one ring being positioned in one of the grooves in the upper segment of the bracket, and the other ring being coupled to the toe edge of the foot plate.

4. The apparatus as set forth in claim 2 and further including a flexible cushion affixed to the lower surface of the center point of the heel edge of the foot plate.

5. The apparatus as set forth in claim 2 and further including flexible pads affixed to the horizontal lower portion of the base beneath each of its corners.

* * * * *